US005374061A

United States Patent [19]

Albrecht

[11] Patent Number: 5,374,061

[45] Date of Patent: Dec. 20, 1994

[54] CARD DISPENSING SHOE HAVING A COUNTING DEVICE AND METHOD OF USING THE SAME

[76] Inventor: Jim Albrecht, 5339 E. Vicksburg, Las Vegas, Nev. 89122

[21] Appl. No.: 996,631

[22] Filed: Dec. 24, 1992

[51] Int. Cl.[5] ..... A63F 1/14

[52] U.S. Cl. ..... 273/149 R

[58] Field of Search ..... 273/148 R, 149 R, 149 P, 273/292, 293, 296, 304, 305

[56] References Cited

U.S. PATENT DOCUMENTS

| | | | |
|---|---|---|---|
| D. 317,951 | 7/1991 | Miller | D21/57 |
| 3,489,907 | 1/1970 | Kenez | 273/149 P X |
| 3,731,936 | 5/1973 | Copeland | 273/149 P |
| 3,751,041 | 8/1973 | Seifert | 273/149 P X |
| 4,088,265 | 5/1978 | Garcyznski | 273/149 X |
| 4,513,969 | 4/1985 | Samsel, Jr. | 273/149 R |
| 4,531,187 | 7/1985 | Uhland | 364/412 |
| 4,534,562 | 8/1985 | Cuff et al. | 273/149 P |
| 4,969,648 | 11/1990 | Hollinger et al. | 273/149 R |
| 5,039,102 | 8/1991 | Miller | 273/148 R |
| 5,067,713 | 11/1991 | Soules et al. | 273/149 P |

*Primary Examiner*—William H. Grieb

*Attorney, Agent, or Firm*—Hill, Steadman & Simpson

[57] ABSTRACT

A system which uses a specially coded deck of cards indicating the value and suit of the card or a value related to the count of the card as well as whether the card belongs to a particular set of cards senses the code on the card and sends the detected signal to a processor. The processor determines a running count, a betting count, a true count or other information related to the profitability of a particular wager or particular action, such as an insurance bet as well as an indication of whether the card belongs to the particular set of cards assigned to the table. The counts are displayed centrally and/or remotely from the shoe which dispenses the cards. The electronics for the system may be internally included as part of the shoe or externally included as a separate unit in which the shoe is secured.

30 Claims, 1 Drawing Sheet

CARD DISPENSING SHOE HAVING A COUNTING DEVICE AND METHOD OF USING THE SAME

BACKGROUND OF THE INVENTION

The present invention generally relates to an apparatus and method for determining at least one "count" of playing cards from a set of cards which are being dealt at a table to one or more players during a game of blackjack. More specifically, the invention relates to a system for automatically counting cards, displaying the counts and verifying that the card dealt belongs to the set of cards assigned to the particular table.

Generally, blackjack is commonly played in casinos and involves a dealer and one or more players who play the cards dealt to them by the dealer against cards dealt to the dealer.

Each player draws cards from the dealer until the sum of the cards are as close to twenty-one as possible without exceeding twenty-one. If the cards dealt to any one player exceed twenty-one or the cards which are dealt to the dealer exceed twenty-one, that player or the dealer holding those cards loses.

To play blackjack, cards are dealt to each player including the dealer with most commonly one card to the dealer face down. After each player and the dealer are dealt two cards with one card facing up and the other facing down for the dealer, if the dealer has one card which is a member of a blackjack pair of cards, the face down card is privately determined by the dealer whether that card is the other member of the blackjack pair. If the two cards make up the blackjack pair for the dealer, play stops and the dealer wins.

An advantage in the game occurs in the favor of the dealer when both the player and the dealer exceed twenty-one (bust). When both the player and the dealer bust, the dealer (or house) wins. To offset this advantage somewhat, the player is given several small advantages.

For example, the player strategizes on his own, but the dealer must draw a card until the total of the cards equals seventeen or greater. In addition, the player may also double his bet and draw exactly one card in favorable situations. Furthermore, a player may split any pair of cards of equal rank and play them as two separate one-card hands. Another advantage is that a player is paid "three-to-two" when the player is dealt a blackjack and has the option to buy insurance when the dealer has an ace card face up.

The options for each player, none of which are available to the dealer, bring the percentage advantage between the player and dealer nearly to zero with perfect play. This was not recognized for many years due to the fact that a vast majority of the players have no idea regarding "proper" strategy.

In 1969, a book "Beat the Dealer" by Edward O. Thorpe was published that changed the game of blackjack dramatically. The book mathematically analyzed each possible situation and described the perfect strategy for the first time. The book offered the player a calculation for a simple "count" that would, when mastered, actually offer a player an edge of approximately one percent against the house. This advantage was, however, not constant, but fluctuating as the cards were dealt. The advantage depended on the remaining distribution of aces and face cards as compared to smaller cards.

Based on the fluctuating count, a player could determine when "good" cards remained and when the cards were in the player's favor. As a result, the advantage fluctuated between an advantage for the house to an advantage for the player. The player-counter simply determined when the cards were in his favor, and when that was the case, increased his bet.

Casinos reacted immediately by changing rules for blackjack, and business fell off as a result. The old rules were then reinstated and business returned. With the old rules, the average player continued to lose at the expected rate, but other players (card counters) seemed to win almost every play.

Casinos reacted by installing a device for dealing multiple decks called a shoe. This device was intended to make counting nearly impossible since the shoe typically holds four to eight decks. Shortly thereafter, systems began to surface for counting multi-deck games. Many counters would form teams or groups of players who would attack these games in a unique manner.

For example, a team often consisted of one "high roller" and several counters. The counters would each find a table where a dealer was shuffling and begin play. A counter would bet the minimum bet while tracking the count on the table. When the count at a particular player's table was favorable, the counter would stand up as a signal to the high roller that the odds for winning at his table were good.

The high roller would approach the table with a handful of large-valued chips. The counter, therefore, indicates to the high roller that the count is positive in the player's favor and the high roller would place large bets and typically win large sums of money from his large bets. In this way, the team players are able to "spread the bet" by placing low bets when the count was bad or while the count was being determined and by placing large bets for good or favorable counts for the player. The high roller appeared to be a superstitious gambler hopping from table to table; however, since the high roller never increased his bet, he was never suspected to be a counter or part of a counter team.

Though the signals between players of a team change, the effect of a good team remains the same—the team wins. Casinos have literally lost millions of dollars by counting teams until gaming commissions were convinced that earlier shuffling was needed. In addition, over 1100 publications exist today that educate blackjack players on various systems to beat the house, such as newsletters which detail the location, table count, number of decks in use, deck penetration and house policies for dealing with counters in casinos throughout the country.

Casinos have responded with two distinct approaches—passive and active. The passive approach involves rule changes and bet restrictions aimed at making advantages to the counter more difficult. The drawback to this approach is that changes which effect the counter also effect the average player and therefore typically cost the casino business. The active approach involves barring players that are too good to beat. The problem here is that only a counter can detect another counter. Floormen within a "pit" of blackjack tables, therefore, must be trained to count and must have the time and energy to continue this activity for an entire shift. This is not an easy task.

In addition to the other responsibilities the floorman faces, his job includes protecting the house from cheating. Typically, each floorman is responsible for watching four to six blackjack tables.

Although there are many ways the house may be cheated, the most devastating is the cold deck or "cooler". The cold deck involves several people working together and may be particularly devastating when using multiple decks. The cold deck furthermore usually involves inside help and the dealer. Normally, the scam takes place in a manner similar to the following:

A team consists generally of nine members, seven of which are at every available seat at a blackjack table. A switchman is in the last seat with four or six decks hidden in a sling under his jacket. The dealer offers a freshly shuffled pack of four or six decks to the switchman for the cut. An eighth man of the team is, for example, across the pit and starts an argument with the dealer at that table about the last hand. The floorman will respond to settle the argument, turning his back to the table where the cooler is to be placed by the switchman. The switchman thereby removes the cooler from his jacket with one hand and the decks from the table with the other. The switch is made rapidly, and the floorman is busy on the other side of the pit. At this point, the switchman leaves the casino with the only evidence, and the ninth player will take his seat so that the table again is totally occupied with team members who are implementing the scam.

The potential for loss to the casino is enormous. A four-deck shoe may be worth in the hundreds of thousands of dollars with typical betting limits. Additionally, absolutely no evidence of any wrongdoing exists since the switchman is gone with the original cards from the shoe. No one knows with any certainty how often this type of scenario takes place, and the casinos are generally reluctant to publicize such occurrences. Typically a nagging suspicion is in the mind of the floorman that such has occurred, but he is often reluctant to pass that suspicion on as it only indicates that he has not properly protected his area of the casino.

SUMMARY OF THE INVENTION

It is, therefore, an object of the present invention to provide a system for attachment to or containment with a normal blackjack shoe. The system provides at least one incremented or accumulated count at a particular table as well as determines whether a particular card being dealt is part of a set of cards originally assigned to a particular table.

The system involves using a special pack of cards encoded with information carrying two types of information: numerical digits and an alphabetical character. The numerical information corresponds to the card value, and the alphabetical information indicates the series of the pack of cards. The information may be in the form of a bar code or some other machine readable form. Magnetic encoding and optical character recognition may, therefore, be implemented.

As the information is read from each card, it is passed to a processor which converts the value of the card to useful information. The information is displayed on a panel on the back of the shoe in the form of at least one count. The display may be driven by the processor which determines the various count numbers.

The conversion to the display of count numbers having an output of numeric information may be easily understood by a trained floorman. A typical output may include a running count, a betting count, a true count and an indication that the card matches or does not match the set of cards which was assigned originally to the table. In an alternative embodiment, the output may be transmitted to a central location where monitoring of all tables may occur.

As a result, the floorman may keep an accurate count at all tables by viewing the output display on the back of each shoe within his area of tables. Furthermore, the integrity of the cards in use may be constantly monitored. Should a cooler be attempted, the chances of successful replacement without detection are slim.

Additional features and advantages of the present invention are described and will be apparent from the detailed description of the presently preferred embodiments and from the drawings.

DETAILED DESCRIPTION OF THE PREFERRED EMBODIMENTS

Figure 1:
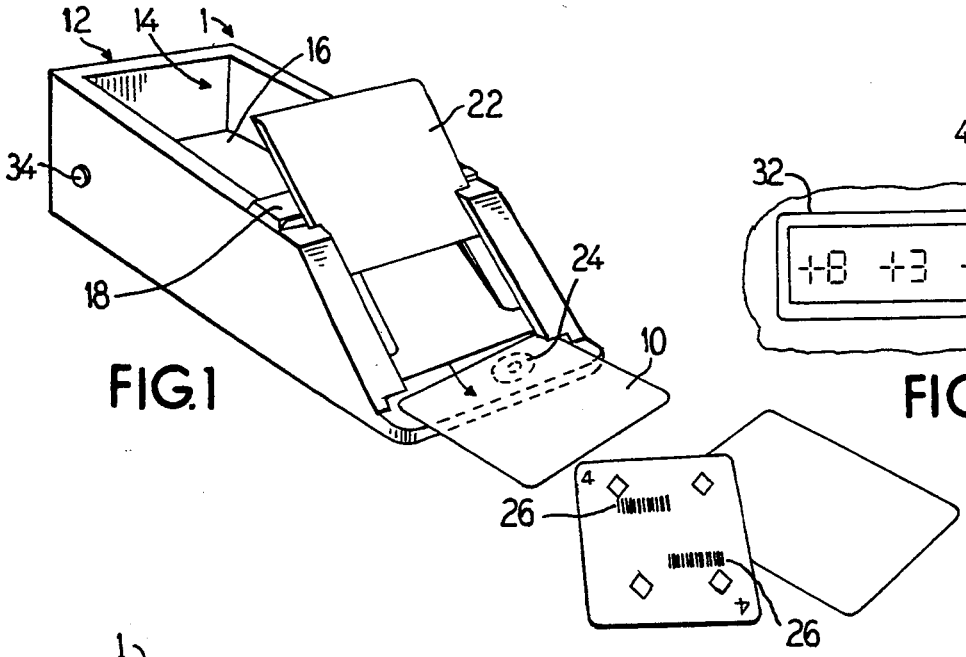
FIG. 1 is a perspective view of the shoe of the present invention.

In accordance with the invention, a system 1 as shown in FIG. 1 is provided for holding a plurality of playing cards 10. Typically, the system 1 includes a shoe 12 for holding playing cards 10. The shoe 12 may be varied in size, but may commonly hold up to eight decks of playing cards 10 within a reservoir 14. The base of the reservoir 14 is generally an inclined ramp 16 in which a block 18 slidingly engages. The block 18 has a steeper ramp sidewall 20 on which the playing cards 10 rest.

The reservoir 14 may secure the cards 10 therein when the system 1 is not being used by closing a door 22 of the shoe 12. The door 22 is inclined substantially the same as the ramp sidewall 20 of the block 18. As shown in FIG. 1, the door 22 is in an open position such that the cards 10 may be dealt through the dispensing portion of the shoe 12.

The cards 10 may, therefore, be dispensed from the shoe 12 individually as shown in FIG. 1. As the cards 10 are dispensed, an optical, magnetic or other sensing device 24 determines the value of the card 10 and whether the card 10 belongs to the set of cards within the reservoir 14 assigned to the shoe 12.

Each card 10 is coded with a code 26 as shown in FIG. 1. For illustration purposes, the code 26 is clearly shown on the card, but it should be understood by one of ordinary skill in the art, the code 26 may be invisibly or visibly encoded on the card or coded in such a way as to become a part of the card itself. The code 26 may, as well, be clearly visible as shown. That is, any means for transferring information, such as optically, magnetically or other known means, from the card 10 by the sensor 24 may be implemented.

Figure 4:
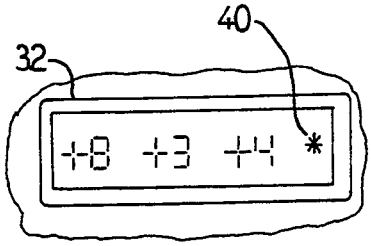
FIG. 4 is a partial plan view of the display portion of the present invention.
Figure 2:
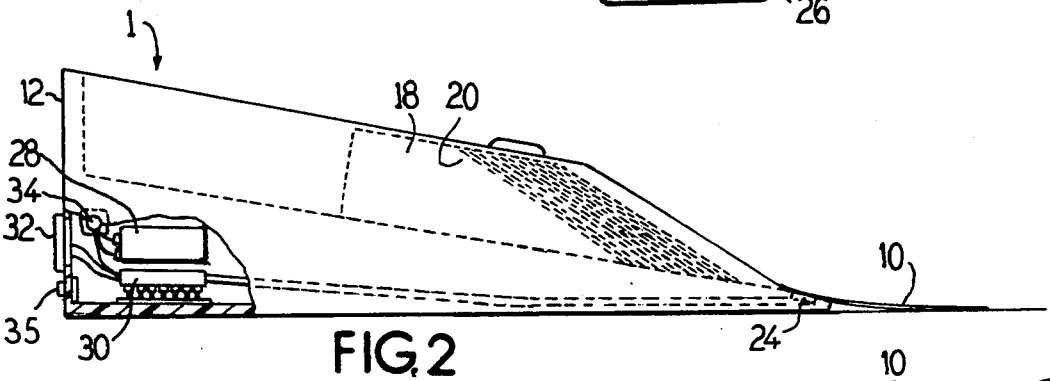
FIG. 2 is a longitudinal cross-sectional view of the shoe of one embodiment of the present invention.

FIG. 2 illustrates an embodiment of the system 1 as shown in FIG. 1 in cross-sectional detail. In this embodiment, the electronics for the shoe 12 are internal. The sensor 24 senses the code on the card 10 as each card is being dealt to each player or to the dealer. A battery 28 provides power to a processor and EPROM chip 30 which converts the signals received from the sensing device 24 into at least one count by suitable programming of the processor 30. A display device 32 also powered by the battery 28 may display a running count, a true count, and a betting count or other information of value in determining the relative edge or profitability of certain bets or actions simultaneously as shown in FIG. 4. Each count is well known in the art and requires that each card 10 is assigned a positive numerical value, a negative numerical value or zero.

When the card is read by the sensing device 24, the signal is sent to the processor 30 which calculates each of the above counts instantaneously and displays the counts on the display 32. The display 32 is located such that the floorman centrally located amongst a plurality of blackjack tables may read the displayed count easily. As shown, the display device 32 is located on a rearwall of the shoe 12 which typically faces away from the players and towards the floorman in the center of the various tables. The display device 32 may, however, be moved appropriately for viewing.

In addition, an indicator 40 (shown in FIG. 4) activates instantaneously after a card 10 is read by the sensing device 24 which does not belong to the assigned set of cards for that table. The processor 30 determines if the card 10 does not belong in the set of cards assigned to this particular shoe 12 by sensing an improper code or no code on a dealt card. As a result, card switching may be recognized by the floorman since the indicator 40 may visually indicate in the form of a light and/or audibly indicate that a card has been dealt which does not belong to the set of cards assigned to the table. The indicator 40 is located on the display device 32 as shown in FIG. 4, but may be moved to a desired location on the shoe 12 or anywhere within the area in which the floorman may easily recognize that such a card has been played. The indicator 40 may generally be nondescript (such as the asterisk shown in FIG. 4), rather than identifying the actually alpha set to which the card which activated the indicator 40 belongs. The floorman only requires awareness that a card not belonging to the set has been played. Therefore, when a card not belonging to the set of cards assigned to the shoe is played, the indicator 40 activates by a flashing signal or other audible and/or visual signals.

A reset button 34 is further included for resetting the displayed count or counts. Since all of the cards of the decks in the shoe 12 are not dealt in a typical game, the ending count, that is the count before reshuffling, can be a positive count, a negative count or zero. After the decks of cards are reshuffled in the shoe 12, the button 34 may be pressed to reset the count or counts to zero. A series number reset 35 is further provided for reseting the displayed count or counts when the series of cards in the shoe 12 is replaced, such as at a shift change. In the preferred embodiment of the invention, the series number reset 35 may be activated by a key to provide an additional security measure.

Figure 3:
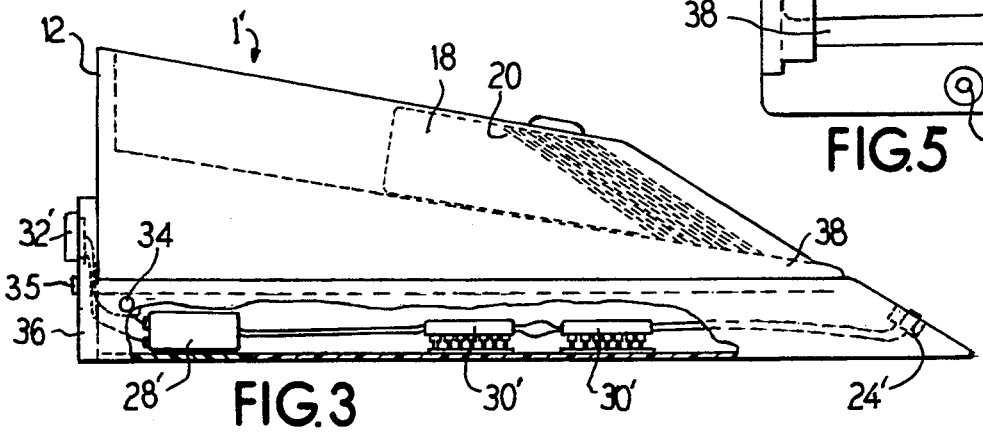
FIG. 3 is a longitudinal cross-sectional view of another embodiment of the present invention.

FIG. 3 illustrates another embodiment of the present invention in which the shoe is a separate self-contained unit 36 which holds the necessary electronics. The process of using this unit is identical to that of the system shown in FIG. 2. This system 1', however, has the electronics within the self-contained unit 36 which acts as a receptacle for the standard shoe 12 which may be set directly onto the unit 36. The card path 38 is somewhat extended by the combined shoe 12 and unit 36, and the overall height of the combined unit 36 and shoe 12 is somewhat increased.

The unit 36 is constructed such that the sensing device 24' is included on the extended ramp portion substantially aligned with the card path 38 of the shoe 12. As discussed with reference to FIG. 2, codes on the cards are detected by the sensing device 24' and sent to the EPROM chip and processor 30' for calculation of the running count, the betting count and the true count.

In addition, the determination is made by the processor 30' whether the card which has been dealt belongs to the set of cards originally included in the shoe 12. The display 32' is included on a backwall of the unit 36 but may be otherwise positioned for convenient recognition. A battery 28' provides power for the EPROM and processor 30' as well as the display device 32'. A reset button 34 is further shown on the sidewall of the shoe 12. The reset button 34 resets the displayed counts after reshuffling as previously described with respect to FIG. 2. Further, a series number reset 35 is also provided for resetting the displayed count or counts when the series of cards in the shoe 12 is replaced as described previously with reference to FIG. 2.

FIG. 4 illustrates an example of the display device 32 for displaying the accumulated counts. A single one, two or all three counts may be displayed at a given time. In addition, the display device 32 itself may include an indication of whether a proper card belonging to a given set has been played. An asterisk 40 exemplifies a particular signal which may be displayed if an improper card is detected. In the alternative, a separate device, such as a light signal or an audible signal, may be used. The three counts which are shown in FIG. 4 (+8, +3 and +4) may as well be zero or negative numbers. As is well known by counters, a large positive count indicates that the odds are favorable for the player. A large negative count indicates the odds are favorable for the dealer. A count of approximately zero indicates that the count neither favors the house or favors the player.

Figure 5:
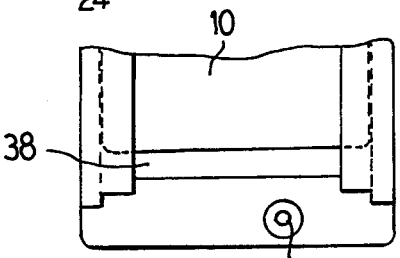
FIG. 5 is a partial plan view of the optical portion of the two embodiments of the present invention.

FIG. 5 illustrates the output path 38 which allows for the card 10 to slide over the sensing device 24 in a substantially uniform manner each time a card is dealt. The sensing device 24 is shown somewhat offset from center requiring each card to include two coded areas such that if the card 10 is inserted or turned 180°, the code 26 will be sensed by the sensing device 24. The sensing device 24 may also be centrally located such that a single code may be included on the card 10 such that if the card is turned 180° the code is always sensed.

The monitoring may also be conducted at a central location in addition to the monitoring performed directly at the table or may be performed exclusively at a remote, central location. The cards are still sensed directly at the table as is shown by either system 1 or 1' of FIGS. 2 and 3, respectively; however, the signals may be sent to the local processor and display and/or to a remote, central location for remote monitoring of the display at a given table.

The advantageous results of the implementation of this system are apparent. Either the floorman or the remote monitor may instantaneously determine when a card has been inserted into the deck or a new deck has been inserted replacing the deck being used by activation of a visible and/or audible signal which indicates this occurrence.

Furthermore, the floorman and/or remote monitor may accurately and automatically count cards along with the expert counter and determine when players are moving to a particular table when a count is very positive in the players' favor. As previously mentioned, a team of players is often formed having a low betting team player at the table while the count is being formed, and a high-betting player replaces the low-betting player when the count has increased in the favor of the players. The present invention provides a system for monitoring and recognizing when these events or similar events are taking place and permits operators of casinos or the like to act appropriately.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. An apparatus for determining at least one count during dealing of a set of playing cards, comprising:

means for holding said set of cards;

means for sensing a mark on each of said plurality of cards as each of said cards is dealt, said mark indicative of a value of each card and further indicative of said card belonging to said set;

means for incrementing said at least one count resulting in at least one accumulated count as each card is dealt; and means for displaying said at least one accumulated count.

2. The apparatus of claim 1 wherein said mark is recorded optically and said means for sensing is an optical character reader.

3. The apparatus of claim 2 wherein said optically recorded mark is a bar code.

4. The apparatus of claim 2 wherein said optically recorded mark consists of existing card graphics.

5. The apparatus of claim 1 wherein said mark is encoded magnetically and said means for sensing is a magnetic scanner.

6. The apparatus of claim 1 further comprising:

means for signaling when one of said cards is sensed as not belonging to said set of cards.

7. The apparatus of claim 6 wherein said means for signaling generates an audible signal.

8. The apparatus of claim 6 wherein said means for signaling generates a visual signal.

9. The apparatus of claim 6 wherein said means for signaling is integral with said means for displaying.

10. The apparatus of claim 1 wherein said at least one accumulated count includes a running count, a betting count, a true count or other indicator of relative distribution of dealt cards.

11. The apparatus of claim 1 wherein said means for displaying is remotely located from said means for holding.

12. The apparatus of claim 1 wherein said means for incrementing and said means for displaying are remotely located from said means for holding.

13. An apparatus for determining at least one count continuously incremented during dealing of a set of cards, said apparatus comprising:

means for sensing a code on each card of said set and generating a signal for each card indicative of said code;

means for processing said signal to increment said at least one count relating to said cards which have been dealt resulting in at least one accumulated count indicative of relative distribution of said dealt cards; and means for displaying said at least one accumulated count.

14. The apparatus of claim 13 further comprising:

means for signaling when a card is sensed not belonging to said set.

15. The apparatus of claim 13 wherein said card is optically recorded and said means for sensing is an optical character reader.

16. The apparatus of claim 15 wherein said optically recorded mark is a bar code.

17. The apparatus of claim 15 wherein said optically recorded mark consists of existing card graphics.

18. The apparatus of claim 13 wherein said code is magnetically recorded and said means for sensing is a magnetic scanner.

19. The apparatus of claim 14 wherein said means for signaling generates an audible signal.

20. The apparatus of claim 14 wherein said means for signaling generates a visual signal.

21. The apparatus of claim 13 wherein said means for displaying is remotely located from said means for sensing.

22. The apparatus of claim 13 wherein said means for displaying and said means for processing are located remotely from said means for sensing.

23. A method for calculating at least one count or other indication of relative distribution relating to playing cards dealt from a set of coded playing cards during a game of blackjack, the method comprising the steps of:

initializing said at least one count to establish an initial value for said at least one count;

sensing a code on each of said playing cards, said code indicative of a value of said card and whether said card belongs to said set;

generating a signal indicative of said sensed code;

processing said signal to increment said at least one count and providing an accumulated count for each of said at least one counts; and displaying each of said accumulated counts.

24. The method of claim 23 further comprising the step of:

activating a signal when said sensed code indicates a card does not belong to said set.

25. The method of claim 23 wherein said code is optically recorded.

26. The method of claim 23 wherein said code is magnetically recorded.

27. The method of claim 25 wherein said optically recorded code is a bar code.

28. The method of claim 23 wherein said displaying is performed remotely from said sensing.

29. The method of claim 23 wherein said processing and said displaying are performed remotely from said sensing.

30. The method of claim 23 further comprising the step of:

removably holding said set of cards such that said sensing may be performed as each card of said set is being dispensed.

* * * * *